US007736206B1

(12) United States Patent
McChesney et al.

(10) Patent No.: US 7,736,206 B1
(45) Date of Patent: Jun. 15, 2010

(54) INTEGRATED TILT/TRIM AND STEERING SUBSYSTEM FOR MARINE OUTBOARD ENGINES

(75) Inventors: Richard McChesney, Waukegan, IL (US); Mark Noble, Pleasant Prairie, WI (US); Rudolf Wendler, Grayslake, IL (US); Matt Leppala, Gurnee, IL (US); George Broughton, Wadsworth, IL (US); LaVerne Tatge, Kenosha, WI (US)

(73) Assignee: BRP US INC., Sturtevant, WI (US)

( * ) Notice: Subject to any disclaimer, the term of this patent is extended or adjusted under 35 U.S.C. 154(b) by 5 days.

(21) Appl. No.: 12/276,535

(22) Filed: Nov. 24, 2008

Related U.S. Application Data

(60) Provisional application No. 60/991,359, filed on Nov. 30, 2007.

(51) Int. Cl.
*B63H 20/08* (2006.01)

(52) U.S. Cl. ..... 440/61 T; 440/53; 440/61 R

(58) Field of Classification Search ..... 440/53, 440/61 A, 61 R, 61 T; 248/641, 642
See application file for complete search history.

(56) References Cited

U.S. PATENT DOCUMENTS 4,687,448 A * 8/1987 Peirce ..... 440/53
4,836,810 A * 6/1989 Entringer ..... 440/61 R
5,327,812 A 7/1994 Weyer et al.
5,924,379 A 7/1999 Masini et al.

* cited by examiner

*Primary Examiner*—Lars A Olson
(74) *Attorney, Agent, or Firm*—Osler, Hoskin & Harcourt LLP

(57) ABSTRACT

A marine outboard engine is disclosed which comprises a drive unit, a tilt/trim/steering subsystem and a stern bracket adapted for connection to an associated watercraft. The tilt/trim/steering subsystem connects the drive unit to the stern bracket and comprises a first rotary actuator carrying the drive unit for pivotal movement about a steering axis that extends generally vertically, and a second rotary actuator connected to the first rotary actuator and supporting the first rotary actuator and the drive unit for pivotal movement about a tilt/trim axis that extends generally horizontally.

12 Claims, 10 Drawing Sheets

INTEGRATED TILT/TRIM AND STEERING SUBSYSTEM FOR MARINE OUTBOARD ENGINES

CROSS-REFERENCE

The present application claims priority to U.S. Provisional Patent Application No. 60/991,359 filed on Nov. 30, 2007, the entirety of which is incorporated herein by reference.

FIELD OF THE INVENTION

The present invention relates generally to steerable and tiltable marine outboard engines and in particular to an integrated tilt/trim and steering subsystem for marine outboard engines.

BACKGROUND OF THE INVENTION

A marine outboard engine generally comprises a stern bracket assembly that is fixed to the stern of a hull (boat) and to an outboard engine main unit incorporating an internal combustion engine, propeller and the like. The marine outboard engine is typically designed so that the steering angle and the tilt/trim angles of the outboard engine relative to the stern brackets (i.e. the steering angle and the tilt/trim angles relative to the boat) can be adjusted and modified as desired. The stern bracket assembly typically includes a swivel bracket carrying the outboard engine for pivotal movement about a steering axis that extends generally vertically, and a clamping bracket supporting the swivel bracket and the outboard engine for pivotal movement about a tilt axis extending generally horizontally.

Known tilt-trim subsystems typically comprise a tilt cylinder unit for swinging a swivel bracket through a relatively large angle to lift the lower portion of the outboard engine above the water level or, conversely, lower the outboard engine below the water level. Such subsystems may further comprise a distinct trim cylinder unit for angularly moving the swivel bracket through a relatively small angle to trim the outboard engine while the lower portion thereof is being submerged. One desirable characteristic of a tilt-trim subsystem would be to provide a slower rate of rotation during trimming to retain the propulsion unit in water for a longer interval during movement thereof through a predetermined angular trim range and thereafter to more rapidly elevate the propulsion unit from the water so as to reach a full tilt-up position. Unfortunately, previous tilt-trim subsystems, as suggested above, may require use of distinct tilt and trim cylinder units or have required use of fairly complex mechanical structures to somewhat meet the tilt-trim requirements of the propulsion unit. Previous subsystems have typically been bulky and cumbersome.

Therefore, there is a need for a tilt-trim and steering subsystem for a marine outboard engine that alleviates some of the drawbacks of prior art systems.

SUMMARY OF THE INVENTION

It is an object of the present invention to ameliorate at least some of the inconveniences present in the prior art.

It is also an object of the present invention to provide an integrated tilt/trim/steering subsystem for a marine outboard engine.

In one aspect, the invention provides a marine outboard engine comprising a drive unit, a tilt/trim/steering subsystem and a stern bracket adapted for connection to an associated watercraft, the tilt/trim/steering subsystem connecting the drive unit to the stern bracket; the tilt/trim/steering subsystem comprising a first rotary actuator carrying the drive unit for pivotal movement about a steering axis that extends generally vertically, and a second rotary actuator connected to the first rotary actuator and supporting the first rotary actuator and the drive unit for pivotal movement about a tilt/trim axis that extends generally horizontally.

In a further aspect the first and second rotary actuator each include a main body having an inside wall, a shaft extending through the main body, the shaft defining an axis of rotation, and a piston having an inside diameter and an outside diameter, the outside diameter of the piston slidably engaged to the inside wall of the main body and the inside diameter of the piston engaging the shaft, wherein axial movement of the piston is converted into rotational movement.

In an additional aspect, the axial movement of the piston in the first rotary actuator is converted into rotational movement of the shaft.

In another aspect, the axial movement of the piston in the second rotary actuator is converted into rotational movement of the main body.

In a further aspect, the shaft of the first rotary actuator includes two ends extending beyond the main body, each end being connected to the drive unit via a bracket, the rotational movement of the shaft being transmitted to the drive unit to effect steering of the marine outboard engine.

In a further aspect, the shaft of the second rotary actuator includes two ends extending beyond the main body, each end being non-rotatably connected to the stern bracket, the rotational movement of the main body being transmitted to the drive unit to effect tilting and trimming of the marine outboard engine.

In an additional aspect, the main body of the first rotary actuator and the main body of the second rotary actuator form a single unit. The main body of the first rotary actuator and the main body of the second rotary actuator are preferably cast into a single unit.

In another aspect, the first rotary actuator and the second rotary actuator are perpendicular to each other.

In an additional aspect, the first and second rotary actuators are hydraulic actuators, each rotary actuator being connected to a control valve system which is connected to a hydraulic pump; wherein axial movement of the piston is effected by hydraulic fluid under pressure pushing on the piston.

In a further aspect, when a control valve of the control valve system is closed, hydraulic fluid is trapped inside one of the first and second rotary actuator and the one of the first and second rotary actuator is locked.

In yet another aspect, the inside diameter of the piston engages the shaft via oblique spline teeth and matching oblique splines.

In another aspect, the ratio between the axial movement of the piston and the converted rotational movement is defined by an angle of the oblique spline teeth and matching oblique splines.

In another aspect, the inside diameter of the piston engages the shaft via a pin and a groove.

In an additional aspect, the pin and groove engagement of the piston and the shaft defines two ratio between the axial movement of the piston and the converted rotational movement of the main body, a first ratio for rotation of the main body to effect tilting of the marine outboard engine, and a second ratio for slower rotation of the main body to effect trimming of the marine outboard engine.

For purposes of this application, the term "horizontal" means that the subject portions, members or components extend generally in parallel to the water surface when the watercraft is substantially stationary with respect to the water surface and when the drive unit 32 is not tilted and is generally placed in the position shown in FIG. 1. The term "vertical" in turn means that portions, members or components extend generally normal to those that extend horizontally.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
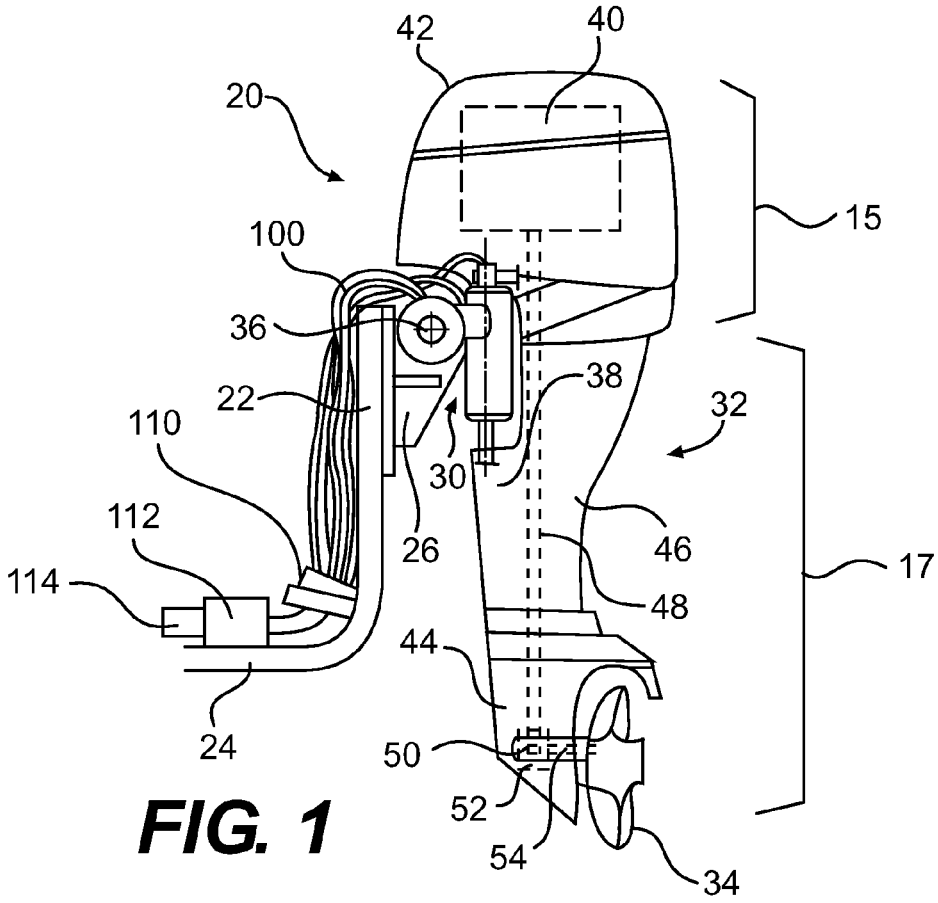
FIG. 1 is a side elevational view of a marine outboard engine in accordance with one embodiment of the invention mounted in the upright position to the transom of a watercraft.

With reference to FIG. 1, the marine outboard engine 20, shown in the upright position, includes a drive unit 32, a stern bracket 26 and an integrated tilt/trim/steering subsystem 30 in accordance with one embodiment of the invention. The stern bracket 26 and the integrated tilt/trim/steering subsystem 30 support the drive unit 32 on a transom 22 of an associated watercraft 24 such that the propeller 34 is in a submerged position with the watercraft 24 resting relative to a surface of a body of water. The drive unit 32 can be tilted up or down relative to the watercraft 24 by the integrated tilt/trim/steering subsystem 30 as illustrated by the arrow "T" in FIG. 2 about a tilt axis 36 extending generally horizontally. The drive unit 32 can also be steered left or right relative to the watercraft 24 by the integrated tilt/trim/steering subsystem 30 about a steering axis 38 extending generally vertically when the drive unit 32 is in the upright position illustrated in FIG. 1

The drive unit 32 includes an upper portion 15 and a lower portion 17. The upper portion 15 includes an engine 40 surrounded and protected by a cowling 42. The engine 40 housed within the cowling 42 is a vertically oriented internal combustion engine, such as a two-stroke or four-stroke engine. The lower portion 17 includes the gear case assembly 44 which includes the propeller 34, and the skeg portion 46 which extends from the upper portion 15 to the gear case assembly 44.

The engine 40 is coupled to a vertically oriented driveshaft 48. The driveshaft 48 is coupled to a drive mechanism 50, which includes a transmission 52 and a propeller 34 mounted on a propeller shaft 54. The driveshaft 48 as well as the drive mechanism 50 are housed within the gear case assembly 44, and transfer the power of the engine 40 to the propeller 34 mounted on the rear side of the gear case assembly 44 of the drive unit 32. It is contemplated that the propulsion system of the outboard engine 20 could alternatively include a jet propulsion device, turbine or other known propelling device. It is further contemplated that the bladed rotor could alternatively be an impeller. Other known components of an engine assembly are included within the cowling 42, such as a starter motor, an alternator and the exhaust system. As it is believed that these components would be readily recognized by one of ordinary skill in the art, further explanation and description of these components will not be provided herein.

Figure 2:
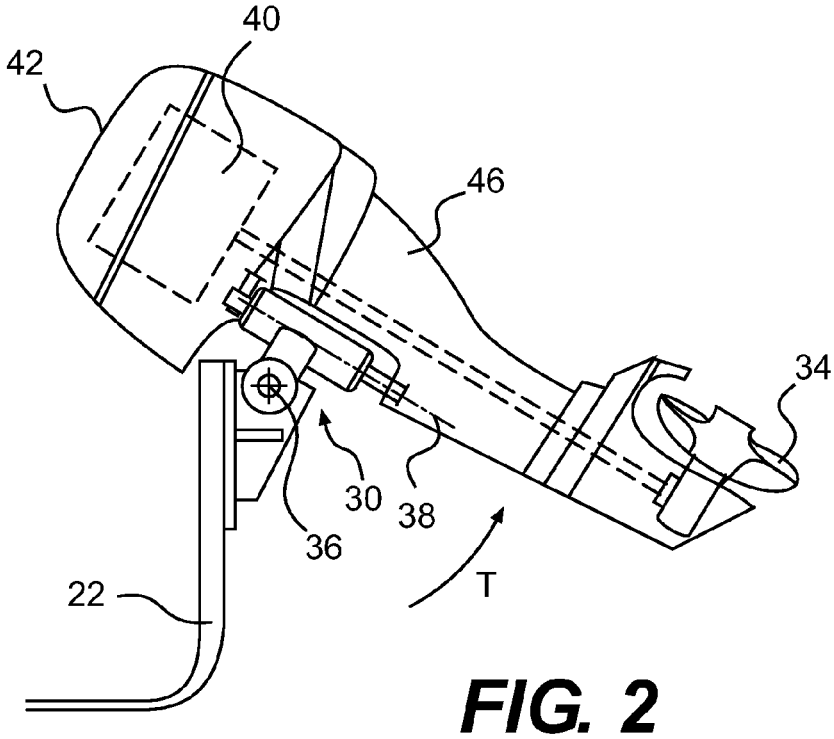
FIG. 2 is a side elevational view of the marine outboard engine shown in FIG. 1 in the fully tilted position.

With reference to FIG. 2, the drive unit 32 of the marine outboard engine 20 is in a fully tilted up position with the propeller 34 completely removed from the surface of a body of water.

Figure 3:
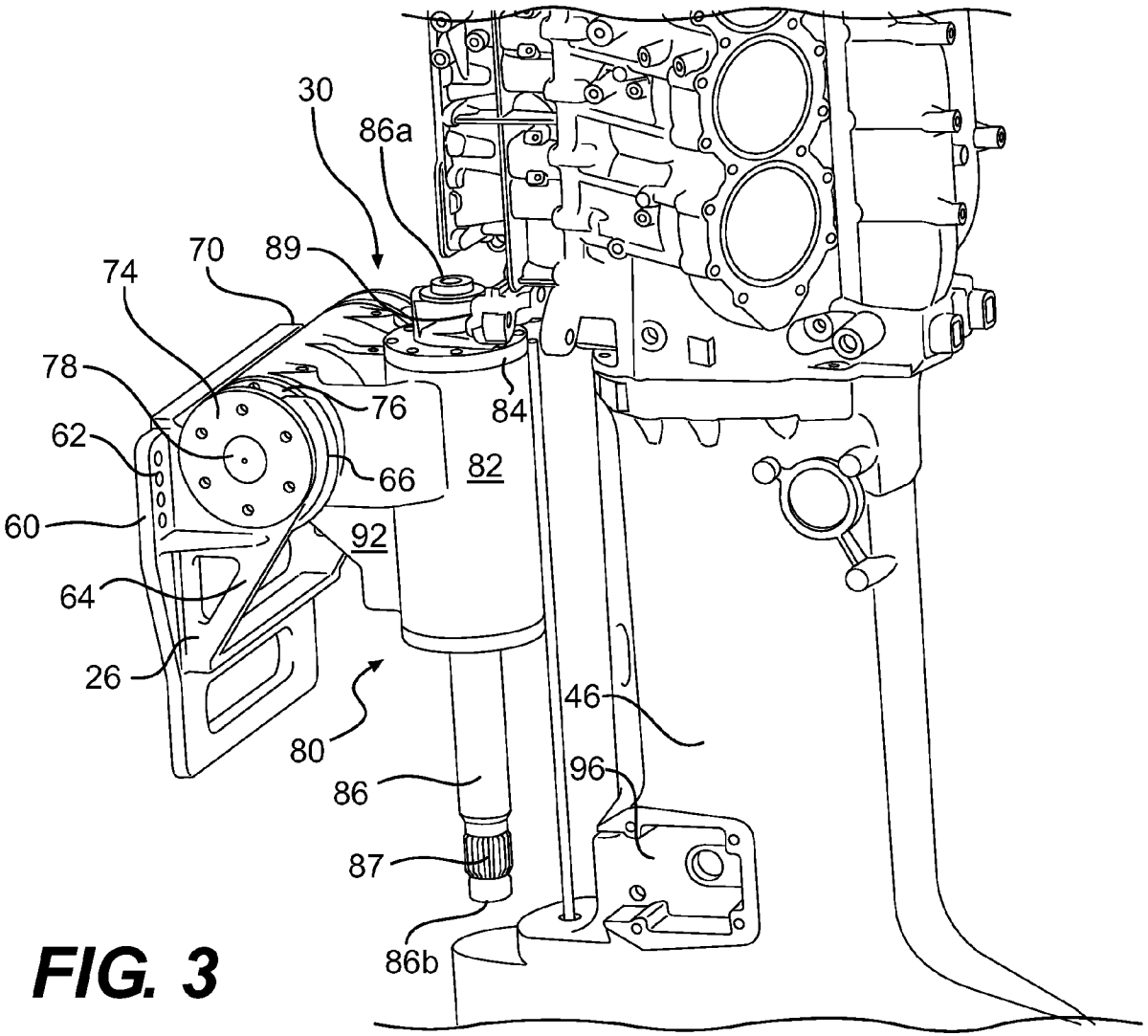
FIG. 3 is a partial rear left perspective view of the marine outboard engine shown in FIG. 1 showing a tilt/trim/steering subsystem of the marine outboard engine.
Figure 4:
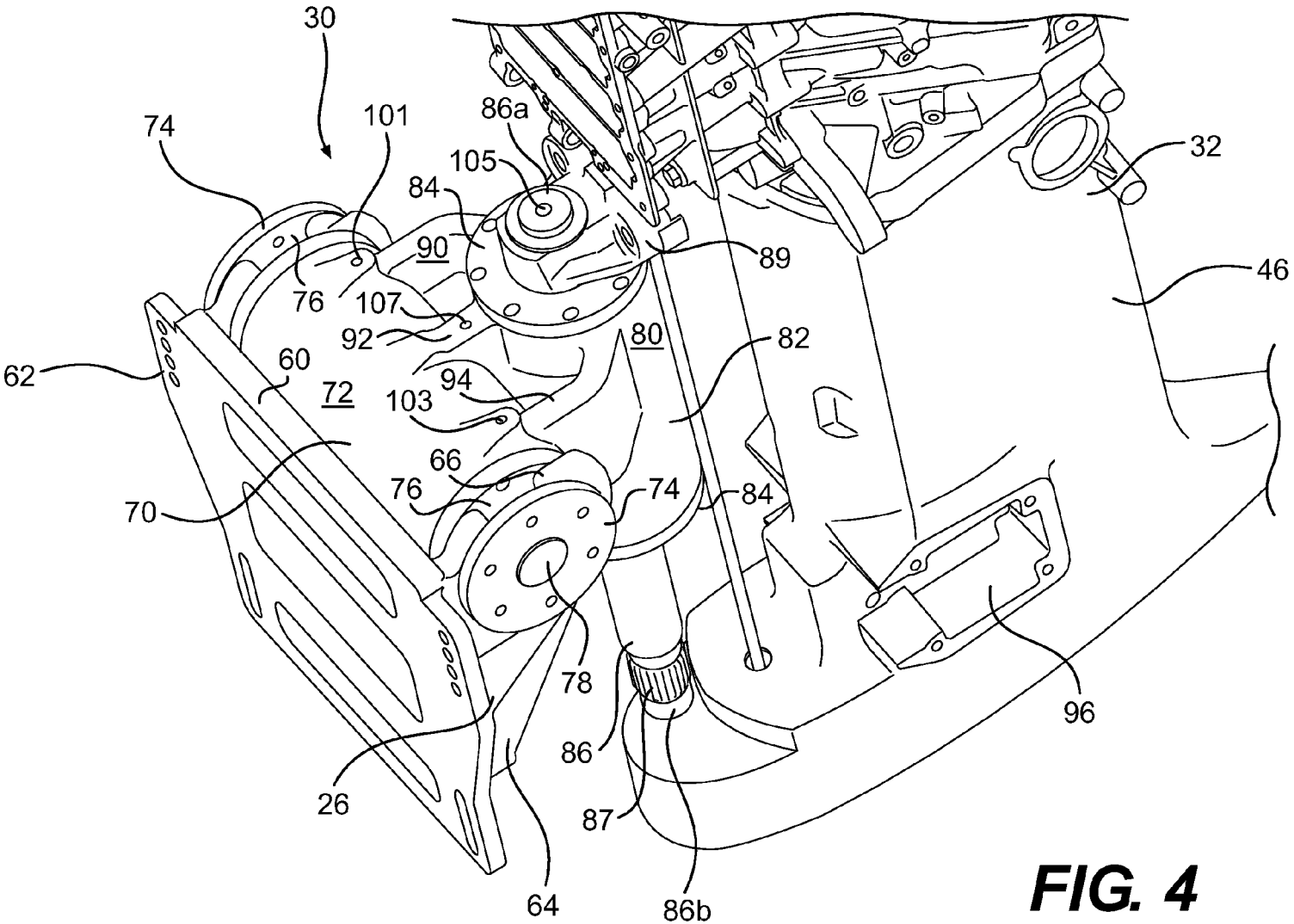
FIG. 4 is a partial front left perspective view of the tilt/trim/steering subsystem shown in FIG. 3.

Referring now to FIGS. 3 and 4, which are close up perspective views of the stern bracket 26 and the tilt/trim/steering subsystem 30, the stern bracket 26 includes an anchoring plate 60 having a series of apertures 62 on each side adapted for fastening the anchoring plate 60 to the transom 22 of the watercraft 24 (FIG. 1). A pair of supporting flanges 64 extend on each side of the stern bracket 26, each supporting flange 64 including a receptacle portion 66 configured to secure and fix the tilt/trim/steering subsystem 30 to the stern bracket 26.

The tilt/trim/steering subsystem 30 includes a tilt/trim hydraulic rotary actuator 70 oriented horizontally relative to the watercraft 24 and a steering hydraulic rotary actuator 80 which is perpendicular to the tilt/trim actuator 70 and oriented vertically when the drive unit 32 of the marine outboard engine 20 is in the upright position as illustrated in FIG. 1. As best seen in FIG. 4, the tilt/trim hydraulic rotary actuator 70 includes a main cylindrical body 72 and two anchoring end portions 74. Each anchoring end portion 74 includes a recess 76 adapted for insertion into the receptacle portions 66 of the supporting flanges 64 for connection to the stern bracket 26. Each anchoring end portion 74 is fixed to the supporting flanges 64 and is non-rotatable relative to the supporting flanges 64 and to the stern bracket 26. The anchoring end portions 74 are connected together via an internal shaft 78 extending the length of the hydraulic rotary actuator 70 which will be described in details with reference to FIG. 8. The main body 72 of the tilt/trim hydraulic rotary actuator 70 is rotatable relative to the anchoring end portions 74 and therefore rotatable relative to the supporting flanges 64 and to the stern bracket 26. Hydraulic fluid is routed into the rotary actuator 70 through a pair of hydraulic apertures 101 and 103 located at each end of the main body 72 of the tilt/trim hydraulic rotary actuator 70.

The steering hydraulic rotary actuator 80 also includes a main cylindrical body 82 and two end plates 84. A central shaft 86 extends through the main body 82 and extends outside the main body 82 from both ends of the cylindrical body 82. The central shaft 86 is rotatable relative to the main body 82. A bracket 89 is non-rotatably connected to a first end 86*a* of the central shaft 86 through splines (not shown). The bracket 89 is adapted for connection to the drive unit 32 with fasteners. The second end 86*b* of the central shaft 86 includes splines 87 similar to the splines on its first end 86*a*. The splines 87 are adapted for non-rotatable connection to a second bracket 95 (FIG. 5) having a pair of arms 97 extending towards the skeg portion 46 of the drive unit 32 and adapted for connection to a pair of recessed portion 96 located on each side of the skeg portion of the drive unit 32. The drive unit 32 is therefore secured to the steering hydraulic rotary actuator 80 also at two points thereby avoiding undue distortion. The drive unit 32 is secured to the first end 86*a* and the second end 86*b* of the central shaft 86 such that when the central shaft 86 is rotated relative to the main cylindrical body 82, the drive unit 32 rotates with the central shaft 86. Hydraulic fluid is routed into the rotary actuator 80 through a first hydraulic aperture 105 (FIG. 6) located at the end 86*a* of the central shaft 86 and through a second hydraulic aperture 107 (FIG. 6) located adjacent the main body 82 of the steering hydraulic rotary actuator 80.

Referring back to FIG. 1, two hydraulic hoses 100 are connected to the apertures 105 and 107 of the steering hydraulic rotary actuator 80 and two hydraulic hoses 100 are connected to the apertures 101 and 103 of the tilt/trim hydraulic rotary actuator 70. The hydraulic hoses 100 are connected to a flow control valve system 110 which is connected to a hydraulic pump 112 powered by an electric motor 114. A controller (not shown) may be connected to the electric motor 114 to efficiently monitor the amount of electrical current used by the electric motor 114. It is contemplated that the tilt/trim hydraulic rotary actuator 70 and the steering hydraulic rotary actuator 80 may alternatively be connected to separate hydraulic pumps 112 powered by separate electric motors 114.

Figure 5:
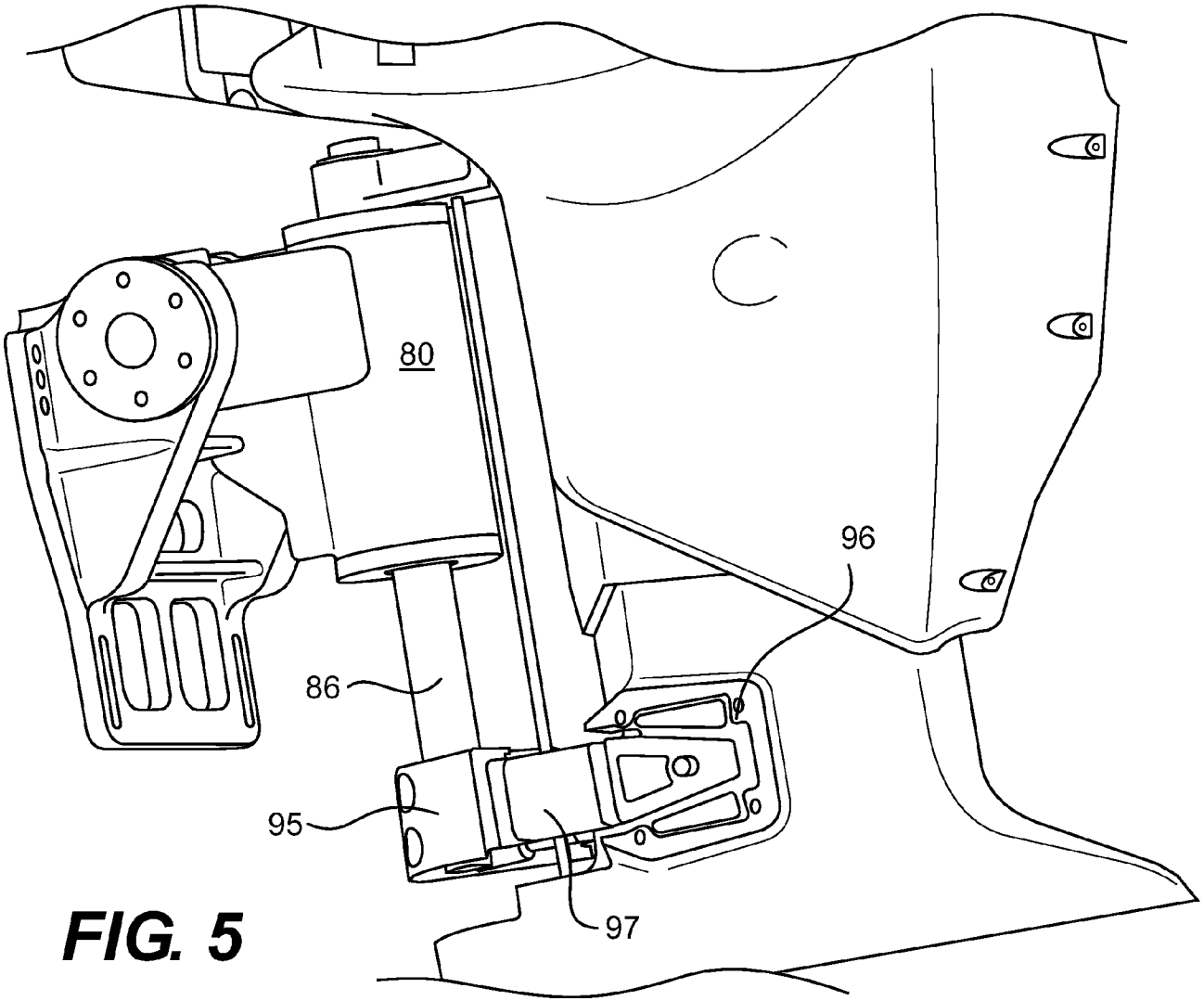
FIG. 5 is a left side elevational view of the tilt/trim/steering subsystem shown in FIG. 3.

With reference to FIGS. 3, 4, and 5, the main cylindrical body 82 of the steering hydraulic rotary actuator 80 is rigidly connected to the main cylindrical body 72 of the tilt/trim hydraulic rotary actuator 70 through a set of reinforcement arms 90, 92 and 94. In the illustrated embodiment, the main cylindrical body 82 of the steering hydraulic rotary actuator 80 and the main cylindrical body 72 of the tilt/trim hydraulic rotary actuator 70 are cast together in a single piece for optimum rigidity and precision of the perpendicularity of the rotary actuators 70 and 80. The tilt/trim hydraulic rotary actuator 70 and steering hydraulic rotary actuator 80 are therefore integrated into a single unit that ensures precise steering and precise trimming of the drive unit 32. The rotary actuators 70 and 80 could also be rigidly connected together through mechanical means or welding or both so as to be integrated as a single unit.

Figure 6:
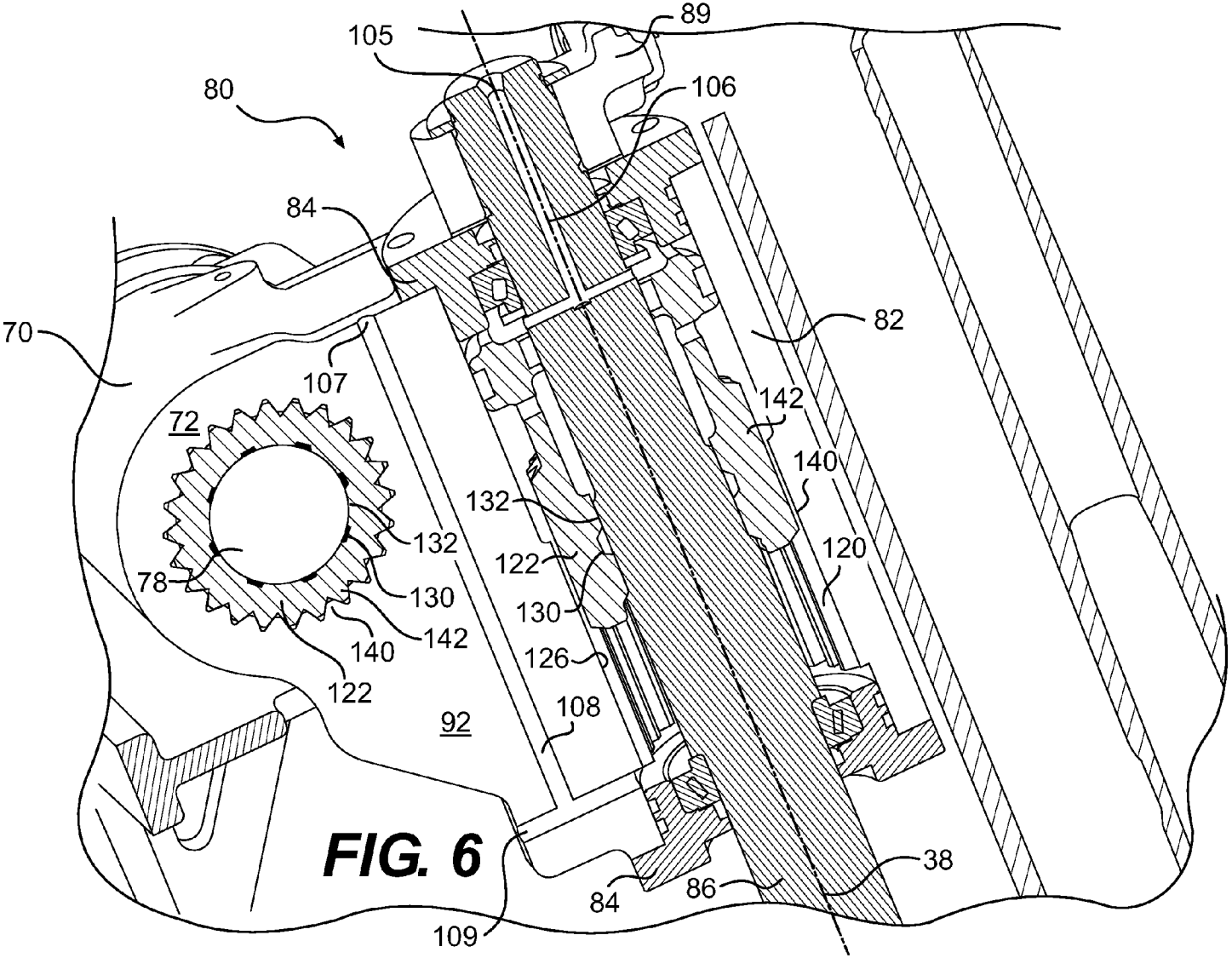
FIG. 6 is a cross sectional view of the tilt/trim/steering subsystem taken along the steering axis.

Referring now to FIG. 6, which is a cross-sectional view of the tilt/trim/steering subsystem 30 taken along the central axis of the central shaft 86 of the steering hydraulic rotary actuator 80, the main cylindrical body 82 of the steering hydraulic rotary actuator 80 and the main cylindrical body 72 of the tilt/trim hydraulic rotary actuator 70 are fused into a single unit. The inner workings of the tilt/trim hydraulic rotary actuator 70 and of the steering hydraulic rotary actuator 80 are similar although the tilt/trim hydraulic rotary actuator 70 may have higher load carrying capability and higher torque output than the steering hydraulic rotary actuator 80 since tilting the drive unit 32 from an upright position as depicted in FIG. 1 to a fully titled horizontal position as depicted in FIG. 2 may require more strength than moving the drive unit 32 left and right for steering and for resisting the thrusting moment created by the propeller 34.

The steering hydraulic rotary actuator 80 includes the cylindrical main body 82 and the two end plates 84 which together define a pressure chamber 120. The central shaft 86 extends through the end plates 84 and through the chamber 120 and defines the steering axis 38. The central shaft 86 is fixed along the steering axis 38 i.e. it does not move longitudinally along the steering axis 38. The central shaft 86 is rotatable about the steering axis 38. A piston 122 surrounds the central shaft 86 and is engaged to the central shaft 86 via oblique spline teeth 130 on central shaft 86 and matching splines 132 on the inside diameter of the piston 122. The piston 122 is slidably engaged to the inside wall 126 of the cylindrical main body 82 via longitudinal spline teeth 142 on the outer diameter of the piston 122 and matching splines 140 on the inside diameter of the main body 82 best shown in the cross-section of the piston 122 of the tilt/trim hydraulic rotary actuator 70. The piston 122 is adapted to slide along the steering axis 38 but is prevented from rotating about the steering axis 38 by the longitudinal matching splines and spline teeth 140, 142.

A first "T" shaped hydraulic conduit 106 is provided through the central shaft 86 and brings hydraulic fluid under pressure from the first hydraulic aperture 105 to the pressure chamber 120 on a first side of the piston 122. A second "T" shaped hydraulic conduit 108 is provided through the reinforcement arm 92 connecting of the main body 72 with the main body 82 and leads hydraulic fluid under pressure from the second hydraulic aperture 107 to the pressure chamber 120 on a second side of the piston 122. The exit 109 of the conduit 108 is a bleeder and is plugged. Hydraulic fluid under pressure moves the piston 122 up and down along the steering axis 38. Hydraulic fluid under pressure entering through the first conduit 106 pushes the piston 122 downwardly, while fluid under pressure entering through the second conduit 108 pushes the piston 122 upwardly. As hydraulic pressure is applied, the piston 122 is displaced axially within the main body 82 and the matching oblique splines 130, 132 cause the central shaft 86 to rotate. The linear motion of the piston 122 is converted into a rotation of the central shaft 86 by the oblique splines 132 on the inside diameter of the piston 122 engaging the matching oblique spline teeth 130 on central shaft 86 and forcing the central shaft 86 to rotate as the piston 122 cannot rotate. When the control valve 110 is closed, hydraulic fluid is trapped inside the pressure chamber 120 and the central shaft 86 is locked in place.

Figure 7:
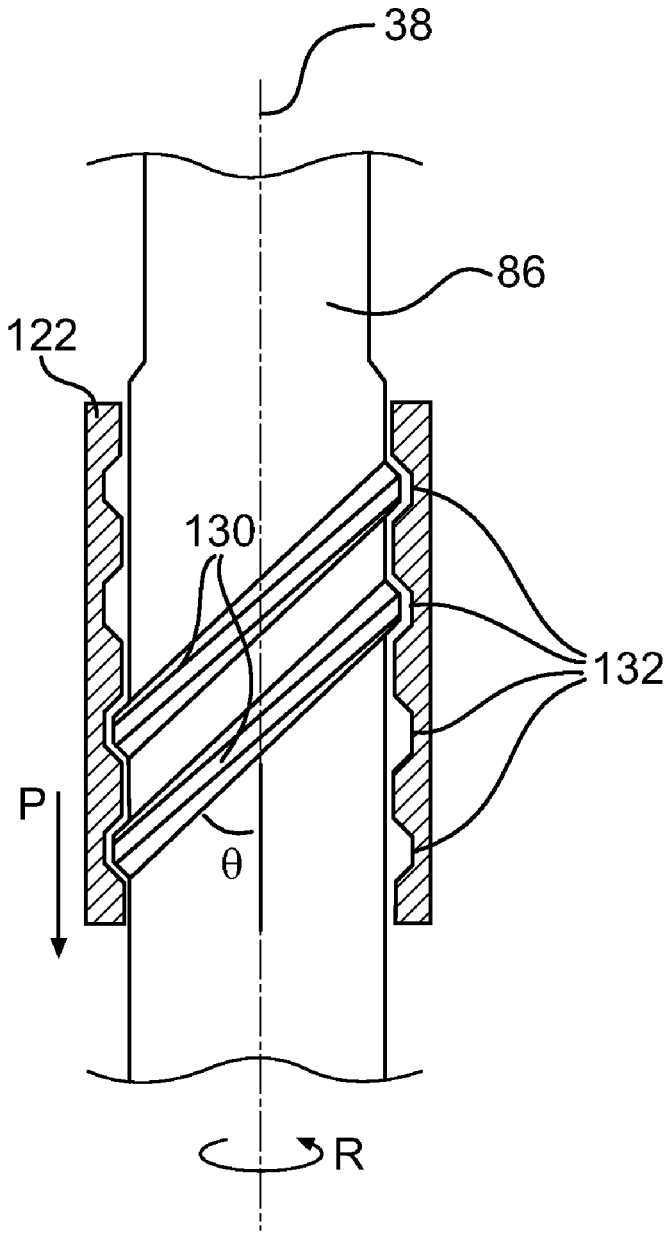
FIG. 7 is a partial schematic view of the some internal components of the tilt/trim/steering subsystem shown in FIG. 3.

Referring now to FIG. 7, when the piston 122 travels downwardly, the splines 132 on the inside diameter of the piston 122 push on the matching spline teeth 130 of central shaft 86 which is forced to rotate clockwise. The oblique spline teeth 130 on central shaft 86 and the matching splines 132 on the inside diameter of the piston 122 are straight and therefore provide a linear conversion of the axial movement "P" of the piston 122 to the clockwise rotation "R" of the central shaft 86. The angle θ of the oblique splines defines the ratio between the axial movement "P" of the piston 122 and the rotation "R" of the central shaft 86. This ratio may be adjusted as desired by the manufacturer by providing a new piston and shaft having spline teeth 130 and matching splines 132 oriented at a different angle θ. The spline teeth 130 and matching splines 132 could also be helical and still provide a linear ratio. The spline teeth 130 and matching splines 132 could be replaced by pins and grooves with similar results.

Figure 8:
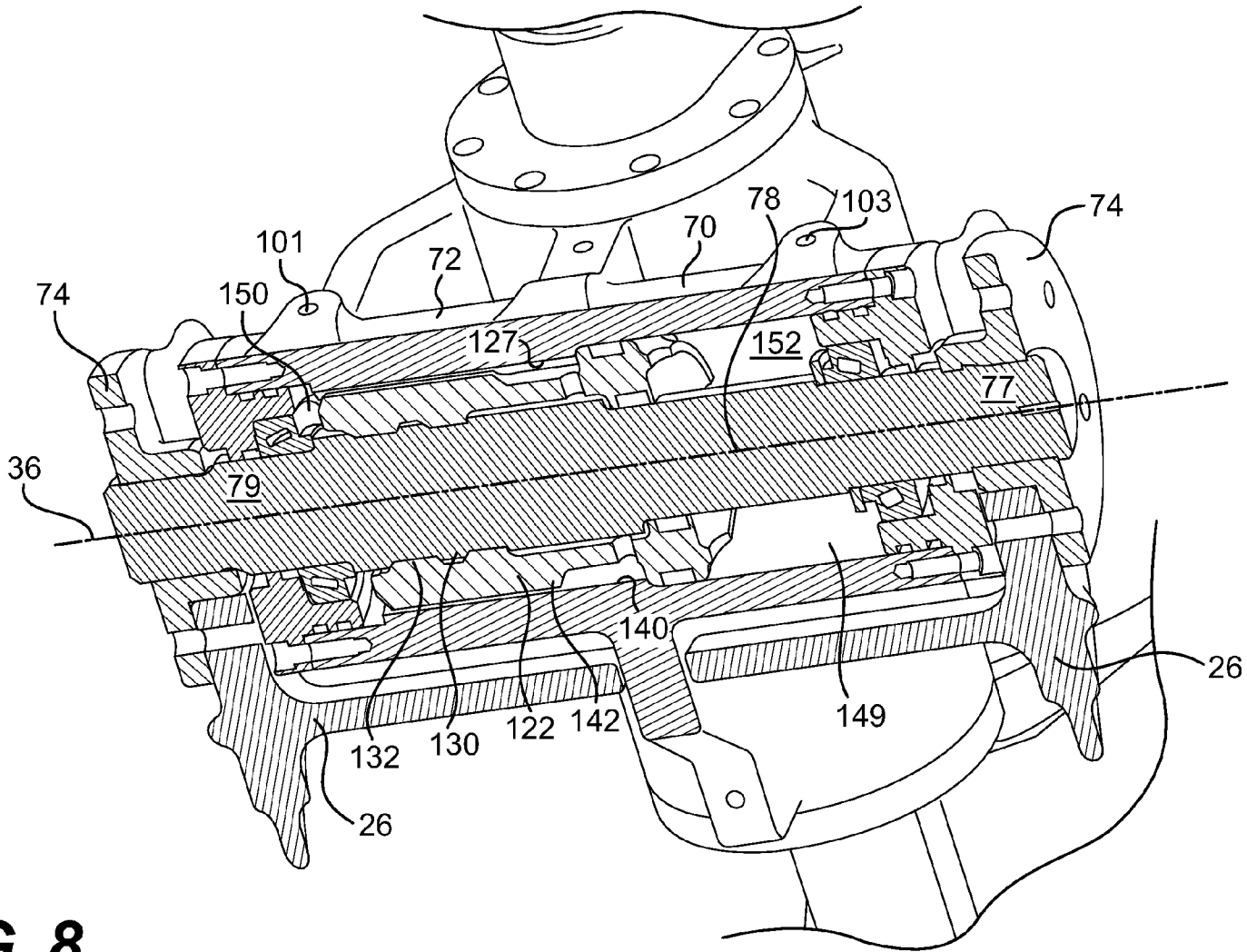
FIG. 8 is a cross sectional view of the tilt/trim/steering subsystem taken along the tilt/trim axis.

Referring now to FIG. 8, a cross-sectional view of the tilt/trim/steering subsystem 30 is shown, taken along the central axis of the internal shaft 78 of the tilt/trim hydraulic rotary actuator 70 which defines the tilt/trim axis 36 of the marine outboard engine 20 (FIG. 1). The tilt/trim hydraulic rotary actuator 70 includes the cylindrical main body 72 and the two end plates 74 which together define a pressure chamber 149. The ends 77 and 79 of the internal shaft 78 are rigidly affixed to the end plates 74 which are themselves rigidly affixed to the supporting flanges 64 of the stern bracket 26. The internal shaft 78 therefore is not rotatable and is fixed relative to the stern bracket 26. As the steering hydraulic rotary actuator 80, the tilt/trim hydraulic rotary actuator 70 includes a piston 122 surrounding the internal shaft 78 and is engaged to the internal shaft 78 via oblique spline teeth 130 on the internal shaft 78 and matching splines 132 on the inside diameter of the piston 122. The piston 122 is slidably engaged to the inside wall 127 of the cylindrical main body 72 via longitudinal spline teeth 142 on the outer diameter of the piston 122 and matching splines 140 on the inside diameter of the main body 72 best shown in the cross-section of the piston 122 of the tilt/trim hydraulic rotary actuator 70 in FIG. 6. The piston 122 is adapted to slide along the tilt axis 36 but is prevented from rotating about the tilt axis 36 by the longitudinal matching splines and spline teeth 140, 142.

A first hydraulic aperture 101 is in fluid communication with the pressure chamber 149 through a hydraulic conduit leading to a first side 150 of the piston 122. A second hydraulic aperture 103 is in fluid communication with the pressure chamber 149 through a hydraulic conduit leading to a second side 152 of the piston 122.

Hydraulic fluid under pressure displaces the piston 122 along the tilt/trim axis 38. Hydraulic fluid under pressure entering through the first aperture 101 pushes the piston 122 towards the end 77 of the internal shaft 78, whereas fluid under pressure entering through the second aperture 103 push the piston 122 towards the end 79 of the internal shaft 78. As hydraulic pressure is applied, the piston 122 is displaced axially within the main body 72 and the matching oblique splines 130, 132 cause the entire main body 72 to rotate. Since the internal shaft 78 is fixed relative to the stern bracket 26 and the piston 122 can only move axially relative to the main body 72, it is the main body 72 that is forced to rotate and by doing so, it rotates the drive unit 32 about the tilt/trim axis 36 as depicted by the arrow "T" in FIG. 2. The linear motion of the piston 122 is therefore converted into a rotation of the main body 72 by the oblique splines 132 on the inside diameter of the piston 122 engaging the matching oblique spline teeth 130 on the internal shaft 78 and by the longitudinal spline teeth 142 on the outer diameter of the piston 122 engaging the matching splines 140 on the inside diameter of the main body 72. When the control valve 110 is closed, hydraulic fluid is trapped inside the pressure chamber 120 and the main body 72 is locked in place.

Figure 9:
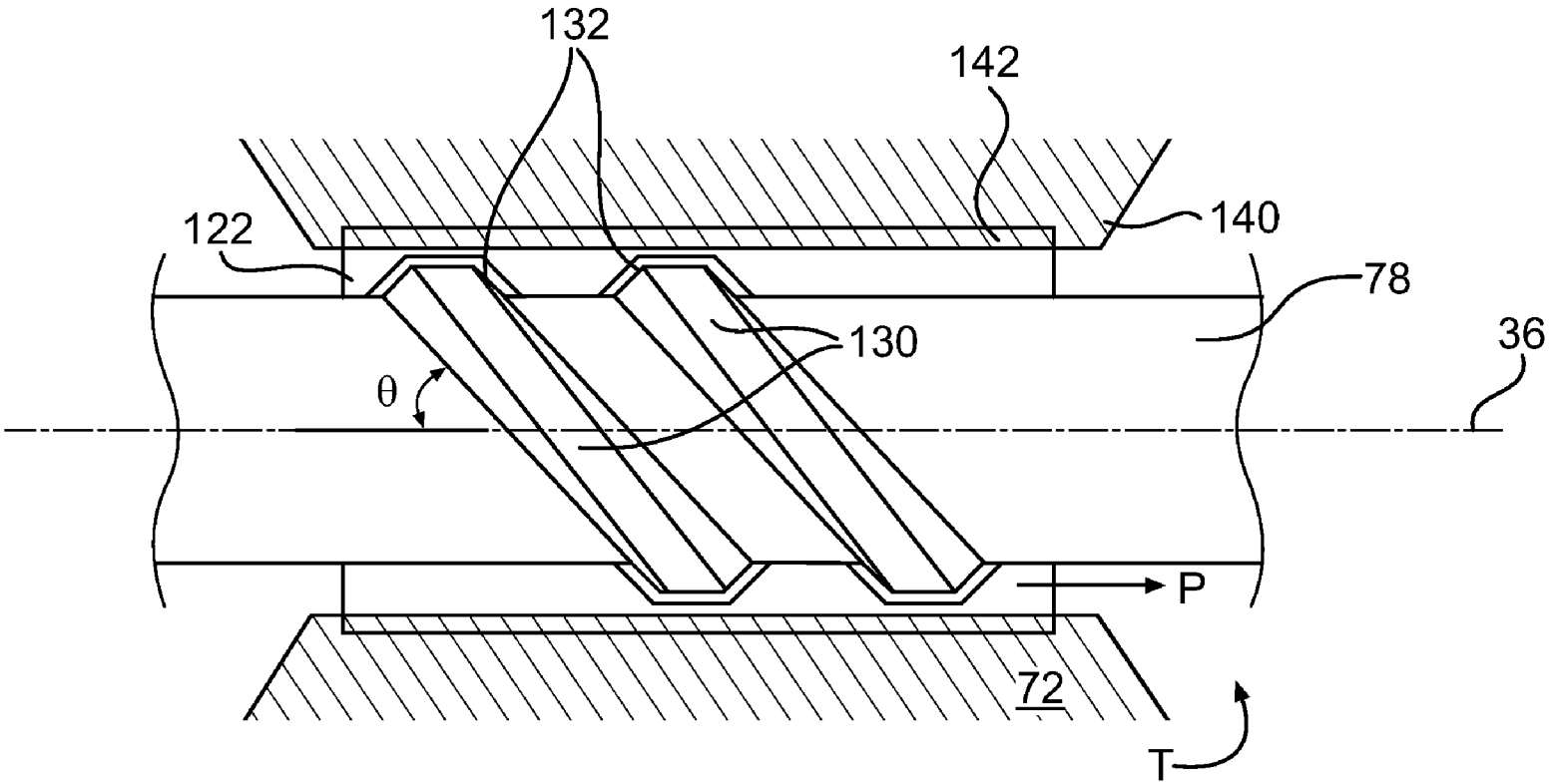
FIG. 9 is a partial schematic view of the some internal components of the tilt/trim/steering subsystem shown in FIG. 3.

Referring now to FIG. 9, the oblique spline teeth 130 on internal shaft 78 and the matching splines 132 on the inside diameter of the piston 122 are straight and provide a linear conversion of the axial movement "P" of the piston 122 to the rotation "T" of the main body 72. The angle θ of the oblique splines defines the ratio between the axial movement "P" of the piston 122 and the rotation "T" of the main body 72. This ratio may be adjusted as desired by the manufacturer by providing a new piston and shaft having spline teeth 130 and matching splines 132 oriented at a different angle θ. The spline teeth 130 and matching splines 132 could also be helical and still provide a linear ratio. The spline teeth 130 and matching splines 132 could be replaced by pins and grooves with similar results.

The tilt/trim hydraulic rotary actuator 70 controls the extended rotation (>90°) of the complete tilt of the outboard engine 20 as illustrated in FIG. 2 as well as the fine tuning trimming of the angle of the propeller 34 when it is submerged in the body of water as illustrated in FIG. 1. The trimming of the angle of the propeller 34 requires small variations of the position of the piston 122 within the main body 72 of the tilt/trim hydraulic rotary actuator 70.

Figure 10:
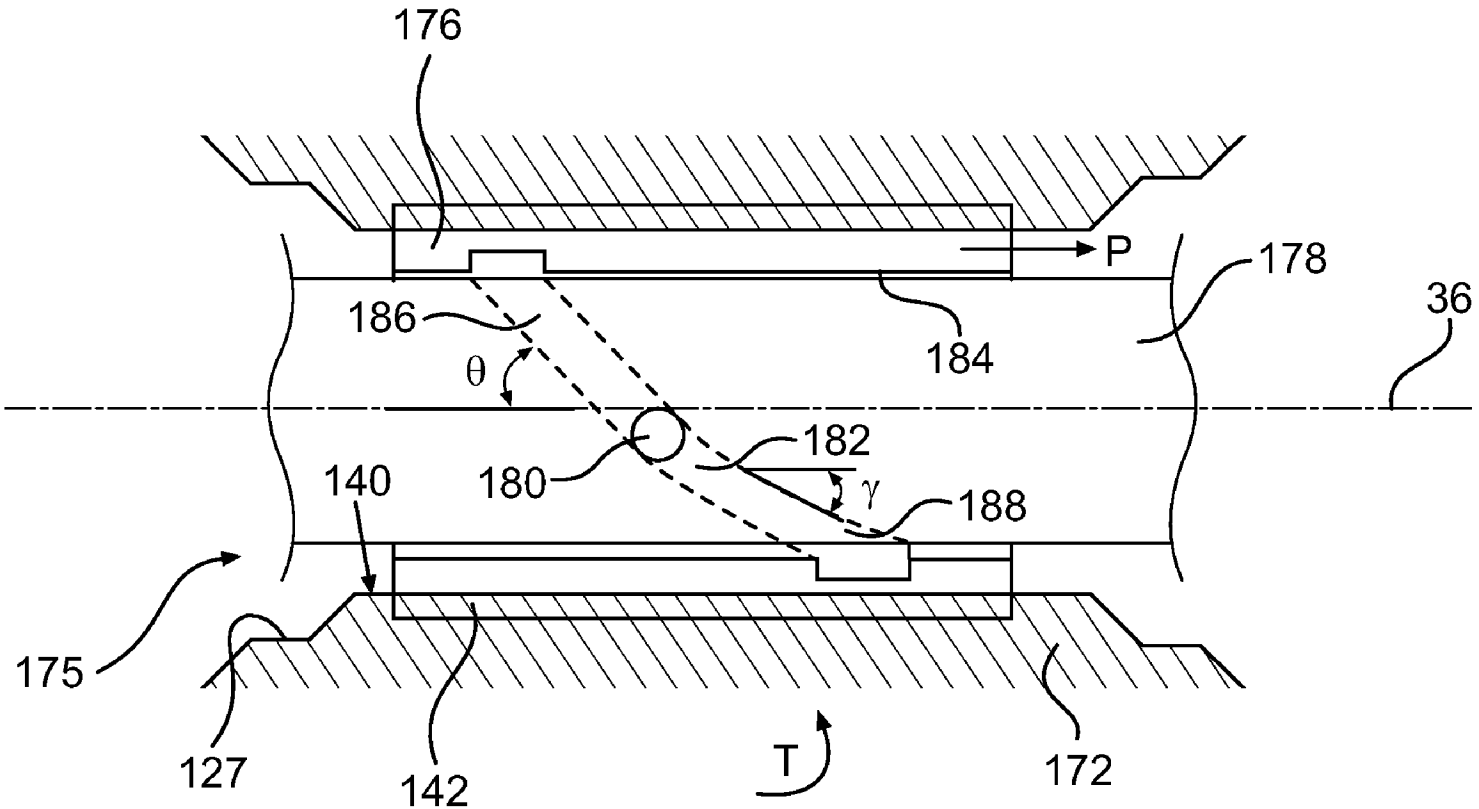
FIG. 10 is a partial schematic view of the some internal components of the tilt/trim/steering subsystem shown in FIG. 3.

With reference to FIG. 10, there is shown an embodiment of a tilt/trim hydraulic rotary actuator 175 wherein the ratio between the axial movement "P" of the piston 176 and the rotation "T" of the main body 172 is different in the tilting portion of the rotation "T" than in the trimming portion of the rotation "T" of the main body 172.

The tilt/trim hydraulic rotary actuator 175 includes a piston 176 surrounding an internal shaft 178. As the embodiment shown and described in FIG. 8, the ends of the internal shaft 178 are rigidly affixed to the end plates 74 which are themselves rigidly affixed to the supporting flanges 64 of the stern bracket 26. The internal shaft 178 therefore is not rotatable and is fixed relative to the stern bracket 26. The piston 176 is slidably engaged to the inside wall 127 of the cylindrical main body 172 via longitudinal spline teeth 142 on the outer diameter of the piston 176 and matching splines 140 on the inside diameter of the main body 172 as best shown in the cross-section of the piston 122 of the tilt/trim hydraulic rotary actuator 70 in FIG. 6. The piston 176 is adapted to slide along the tilt axis 36 but is prevented from rotating about the tilt axis 36 by the longitudinal matching splines and spline teeth 140, 142.

The internal shaft 178 is engaged to the piston 176 via a pin 180 inserted in a groove 182 on the inside diameter 184 of the piston 176. The groove 182 defines a first segment 186 having an angle θ with respect to the longitudinal axis of the shaft 178 and a second segment 188 having an angle γ with respect to the longitudinal axis of the shaft 178. As previously described, when hydraulic pressure is applied on either side of the piston 176, the piston 176 is displaced axially within the main body 172 and the pin 180 and groove 182 cause the main body 172 to rotate. The first segment 186 defines the ratio between the axial movement "P" of the piston 176 and the rotation "T" of the main body 172 in the tilting portion of the rotation "T", whereas the second segment 188 defines the ratio between the axial movement "P" of the piston 176 and the rotation "T" of the main body 172 in the trimming portion of the rotation "T" of the main body 172. In the tilting portion defined by the first segment 186, the rotation "T" of the main body 172 is more rapid than in the trimming portion of the rotation "T" of the main body 172 for the same amount of longitudinal movement of the piston 176. Because the angle θ of the tilting portion 186 is greater than the angle γ of the trimming portion 188, the main body 172 rotates more per unit length of axial movement "P" of the piston 176 than in the trimming portion 188.

Because there is less rotation of the main body 172 per unit length of axial movement "P" of the piston 176 in the trimming portion 188, it is easier for the operator of the watercraft to adjust and control the angle of the propeller 34 when it is submerged in the body of water as shown in FIG. 1. Because the piston 176 must travel more per unit of rotation of the main body in the trimming portion 188, the operator of the watercraft is able to fine tune the angle of the propeller 34 with more ease.

Figure 11:
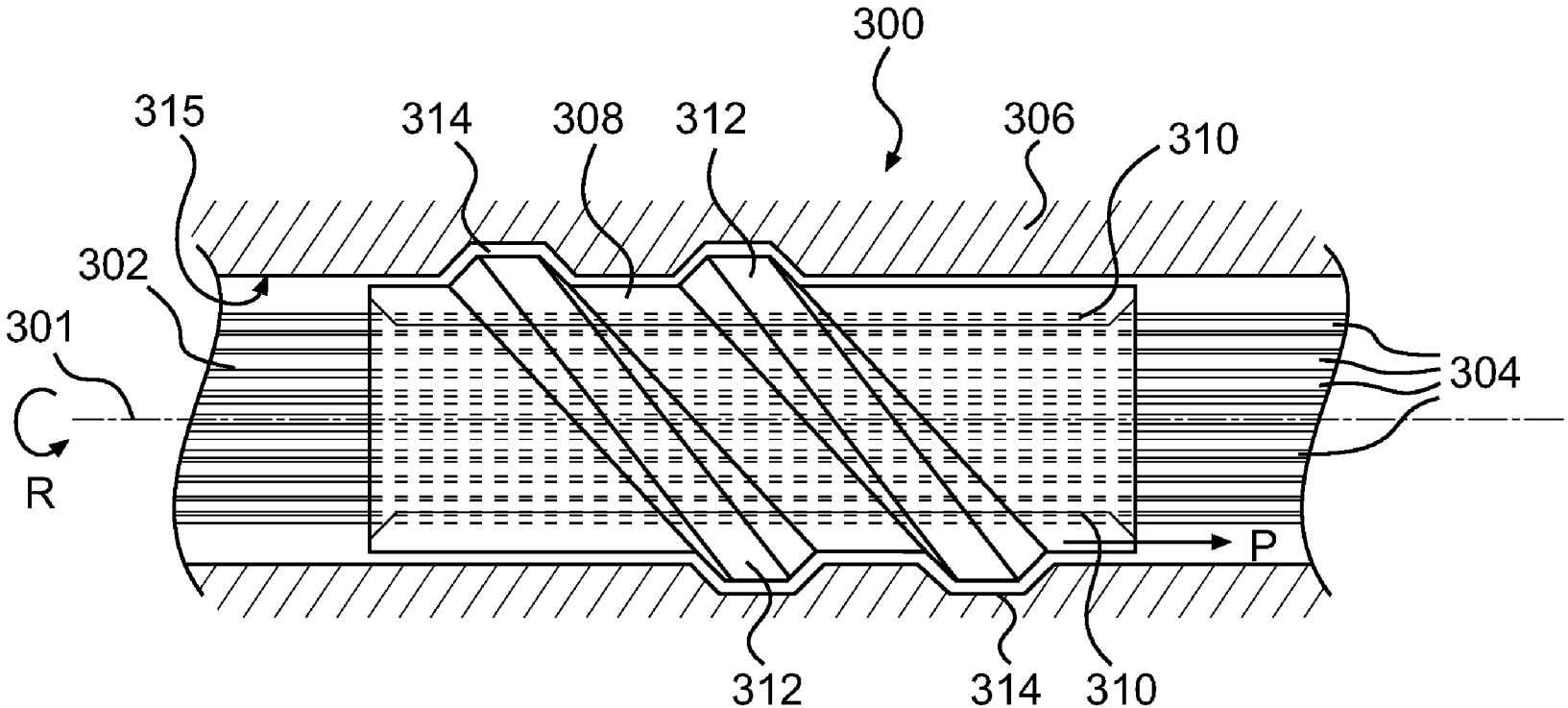
FIG. 11 is a partial schematic view of the some internal components of another embodiment of a hydraulic rotary actuator.

Referring now to FIG. 11, a cross-sectional view of another embodiment of the internal workings of a hydraulic rotary actuator 300 is shown, taken along the central axis 310 of the internal shaft 302. The hydraulic rotary actuator 300 includes a main body 306, a piston 308 and the internal shaft 302. The internal shaft 302 includes a series of straight splines 304 engaging matching splines 310 on the inside diameter of the piston 308. The outer diameter of the piston 308 is engaged to the main body 306 via oblique spline teeth 312 on the outer diameter of the piston 308 and matching oblique splines 314 on the internal wall 315 of the main body 306. As the piston 308 is pushed by hydraulic fluid under pressure in the direction the piston 308 is forced to rotate by the matching oblique splines 312, 314. The rotation of the piston 308 is transferred to the internal shaft 302 which is also forced to rotate in the direction C. The internal shaft 302 rotates in the same direction as the piston 308. When the ends of the internal shaft 302 are connected for rotation and the main body 306 is fixed, the rotation of the internal shaft 302 imparts the rotational movement. When the ends of the internal shaft 302 are fixed and the main body 306 is connected for rotation, the linear rotation of the piston 308 is transferred directly to the main body 306 which imparts the rotational movement.

The embodiment illustrated in FIG. 11 demonstrates that the matching oblique splines and the straight splines can be either on the internal shaft, on the inner diameter or outer diameter of the piston, or on the inside wall of the main body 306.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A marine outboard engine for a watercraft, comprising:

a stern bracket for mounting the marine outboard engine to the watercraft;

a tilt/trim/steering subsystem pivotably connected to the stern bracket; and a drive unit pivotably connected to the tilt/trim/steering subsystem, the tilt/trim/steering subsystem comprising:

a housing;

a first rotary actuator disposed in the housing for pivoting the tilt/trim/steering subsystem relative to the stern bracket about a generally horizontal tilt/trim axis; and a second rotary actuator disposed in the housing for pivoting the drive unit relative to the tilt/trim/steering subsystem about a steering axis generally perpendicular to the tilt/trim axis.

2. The marine outboard engine of claim 1, wherein:

the first rotary actuator includes:

a first main body having a first inside wall;

a first piston disposed within the first main body; and a first shaft extending through the first piston, the first shaft being oriented generally parallel to the tilt/trim axis, such that linear movement of the first piston within the first main body along the tilt/trim axis causes pivotal movement of the tilt/trim/steering subsystem relative to the stern bracket; and the second rotary actuator includes:

a second main body having a second inside wall;

a second piston disposed within the second main body; and a second shaft extending through the second piston, the second shaft being oriented generally parallel to the steering axis, such that linear movement of the second piston within the second main body along the steering axis causes pivotal movement of the drive unit relative to the tilt/trim/steering subsystem.

3. The marine outboard engine of claim 2, wherein the first and second rotary actuators are first and second hydraulic actuators.

4. The marine outboard engine of claim 3, further comprising at least one hydraulic pump, the at least one hydraulic pump being connected to the first and second hydraulic actuators via a control valve system to cause linear movement of the first and second pistons within a corresponding one of the first and second main bodies.

5. The marine outboard engine of claim 2, wherein the first and second main bodies are formed in the housing.

6. The marine outboard engine of claim 2, wherein:

the first piston engages the first shaft via one of a first longitudinal spline connection and a first oblique spline connection;

the first piston engages the first main body via the other of the first longitudinal spline connection and the first oblique spline connection;

the second piston engages the second shaft via one of a second longitudinal spline connection and a second oblique spline connection; and the second piston engages the second main body via the other of the second longitudinal spline connection and the second oblique spline connection.

7. The marine outboard engine of claim 6, wherein:

the first piston engages the first shaft via the first longitudinal spline connection;

the first piston engages the first main body via the first oblique spline connection;

the second piston engages the second shaft via the second longitudinal spline connection; and the second piston engages the second main body via the second oblique spline connection.

8. The marine outboard engine of claim 6, wherein:

the first piston engages the first shaft via the first oblique spline connection;

the first piston engages the first main body via the first longitudinal spline connection;

the second piston engages the second shaft via the second oblique spline connection; and the second piston engages the second main body via the second longitudinal spline connection.

9. The marine outboard engine of claim 2, wherein:

the first piston engages the first shaft via one of a first longitudinal spline connection and a first pin received in a corresponding first groove;

the first piston engages the first main body via the other of the first longitudinal spline connection and the first pin received in the corresponding first groove;

the second piston engages the second shaft via one of a second longitudinal spline connection and a second pin received in a corresponding second groove; and the second piston engages the second main body via the other of the second longitudinal spline connection and the second pin received in the corresponding second groove.

10. The marine outboard engine of claim 9, wherein:

the first piston engages the first shaft via the first pin received in the corresponding first groove;

the first piston engages the first main body via the first longitudinal spline connection;

the second piston engages the second shaft via the second pin received in the corresponding second groove; and the second piston engages the second main body via the second longitudinal spline connection.

11. The marine outboard engine of claim 9, wherein:

the tilt/trim/steering subsystem pivots relative to the stern bracket at a first rate when the steering axis is substantially vertical; and the tilt/trim/steering subsystem pivots relative to the stern bracket at a second rate greater than the first rate when the steering axis is not substantially vertical.

12. The marine outboard engine of claim 11, wherein the first groove has:

a first segment having a first angle relative to a longitudinal axis of the first shaft; and a first segment having a second angle relative to a longitudinal axis of the first shaft, the second angle being greater than the first angle, such that:

the tilt/trim/steering subsystem pivots relative to the stern bracket at the first rate when the first pin engages the first segment; and the tilt/trim/steering subsystem pivots relative to the stern bracket at the second rate when the first pin engages the second segment.

* * * * *